US007908672B2

(12) United States Patent
Butler

(10) Patent No.: US 7,908,672 B2
(45) Date of Patent: Mar. 22, 2011

(54) GLOVE HAVING WEIGHT-RECEIVING FEATURES AND WEIGHTED FEATURES

(76) Inventor: Jason E. Butler, Apache Junction, AZ (US)

( * ) Notice: Subject to any disclaimer, the term of this patent is extended or adjusted under 35 U.S.C. 154(b) by 81 days.

(21) Appl. No.: 12/165,823

(22) Filed: Jul. 1, 2008

(65) Prior Publication Data

US 2010/0000006 A1 Jan. 7, 2010

(51) Int. Cl.
*A41D 19/02* (2006.01)

(52) U.S. Cl. ..... 2/162; 482/105

(58) Field of Classification Search ..... 2/160, 162; 482/46, 105

See application file for complete search history.

(56) References Cited

U.S. PATENT DOCUMENTS 4,684,123 A * 8/1987 Fabry ..... 482/105
4,923,418 A * 5/1990 Hoffman ..... 441/57
5,683,335 A * 11/1997 Groves et al. ..... 482/105
5,704,883 A * 1/1998 Eckmann ..... 482/105
6,760,924 B2 * 7/2004 Hatch et al. ..... 2/161.5
2006/0272072 A1 * 12/2006 Murphy ..... 2/161.1

* cited by examiner

*Primary Examiner* — Katherine Moran
(74) *Attorney, Agent, or Firm* — Parsons & Goltry; Michael W. Goltry; Robert A. Parsons

(57) ABSTRACT

A glove includes a glove body including opposing dorsal and palmar side panels, opposing proximal and distal ends, a wrist portion formed in the proximal end, and finger stalls formed in the distal end. An elongate strap has an inner end secured to the wrist portion of the glove body and an opposed free outer end, and a plurality of weight-receiving pockets formed in the elongate strap between the inner end of the elongate strap and the outer end of the elongate strap. Corresponding engagement and complemental engagement elements are carried by the elongate strap. The elongate strap is movable between a first position extending away from the wrist portion and a second position wrapped about the wrist portion engaging the engagement element to the complemental engagement element securing the elongate strap in the second position.

20 Claims, 11 Drawing Sheets

20
55
90
93
94
104
104
104

GLOVE HAVING WEIGHT-RECEIVING FEATURES AND WEIGHTED FEATURES

FIELD OF THE INVENTION

The present invention relates to gloves and, more particularly, to sports training gloves.

BACKGROUND OF THE INVENTION

There are many different types of gloves, which are used while playing sports and participating in other activities. These sports can include football, tennis, racquetball, golf, baseball, basketball, and boxing. The gloves are generally designed to improve performance and/or to provide protection while playing.

Among the various types of sports, the sports of golf, baseball, boxing, tennis, racquetball, and others, utilize gloves for protecting the hand or hands of a user. To become increasingly skilled and proficient at such sports, Weight or resistance training is a common component of a well-rounded training regimen. Although traditional weight training is often the primary means of gaining muscle and joint strength, sports-specific resistance training often provides highly beneficial results.

Accordingly, there is a need for an improved glove having weight receiving features and weighted features that that may be used during sports training activities for providing sports-specific resistance training benefits.

SUMMARY OF THE INVENTION

According to the invention, a glove consists of a glove body including opposing dorsal and palmar side panels, opposing proximal and distal ends, a wrist portion formed in the proximal end, and finger stalls formed in the distal end. An elongate strap has an inner end secured to the wrist portion of the glove body and an opposed free outer end, and a plurality of weight-receiving pockets formed in the elongate strap between the inner end of the elongate strap and the outer end of the elongate strap. Corresponding engagement and complemental engagement elements are carried by the elongate strap. The elongate strap is adjustable between a first position extending away from the wrist portion and a second position wrapped about the wrist portion engaging the engagement element to the complemental engagement element of the engagement pair securing the elongate strap in the second position. The pockets each include a closed end and an opposed open end for installing and removing a weight relative to the pocket. A flap is secured to the elongate strap, and is movable between an open position exposing the open ends of the pockets and a closed position extending across and closing the open ends of the pockets. The flap is elastically constrictive biasing the flap in the closed position. The engagement element is formed proximate to the inner end of elongate strap and the complemental engagement element is formed proximate to the outer end of the elongate strap. In a particular embodiment, the engagement element consists of one of a hook medium and a loop medium, and the complemental engagement element consists of the other of the hook medium and the loop medium. The dorsal side panel is severed forming a first portion of the dorsal side panel toward the proximal end of the glove body and a second portion of the dorsal side panel toward the distal end of the glove body, in which the second portion of the dorsal side panel capable of displacing between a first position away from the first portion of the dorsal side panel and a second position toward the first portion of the dorsal side panel. Protective knuckle padding is formed in the second portion of the dorsal side panel. The first portion of the first portion of the dorsal side panel is formed with weights.

According to the invention, a glove consists of a body including opposing dorsal and palmar side panels, opposing proximal and distal ends, a wrist portion formed in the proximal end, and finger stalls formed in the distal end. An elongate strap has an inner end secured to the wrist portion of the glove body and an opposed free outer end. Weights are carried by the elongate strap between the inner end of the elongate strap and the outer end of the elongate strap. Corresponding engagement and complemental engagement elements are carried by the elongate strap. The elongate strap is movable between a first position extending away from the wrist portion and a second position wrapped about the wrist portion engaging the engagement element to the complemental engagement element securing the elongate strap in the second position. The engagement element is formed proximate to the inner end of elongate strap and the complemental engagement element is formed proximate to the outer end of the elongate strap. The engagement element consists of one of a hook medium and a loop medium, and the complemental engagement element consists of the other of the hook medium and the loop medium. The dorsal side panel is severed forming a first portion of the dorsal side panel toward the proximal end of the glove body and a second portion of the dorsal side panel toward the distal end of the glove body, in which the second portion of the dorsal side panel is capable of displacing between a first position away from the first portion of the dorsal side panel and a second position toward the first portion of the dorsal side panel. Protective knuckle padding is formed in the second portion of the dorsal side panel. Weights are carried by the first portion of the dorsal side panel.

Consistent with the foregoing summary of preferred embodiments, and the ensuing detailed description, which are to be taken together, the invention also contemplates associated embodiments.

BRIEF DESCRIPTION OF THE DRAWINGS

Referring to the Drawings.

DETAILED DESCRIPTION OF PREFERRED EMBODIMENTS

Figure 1:
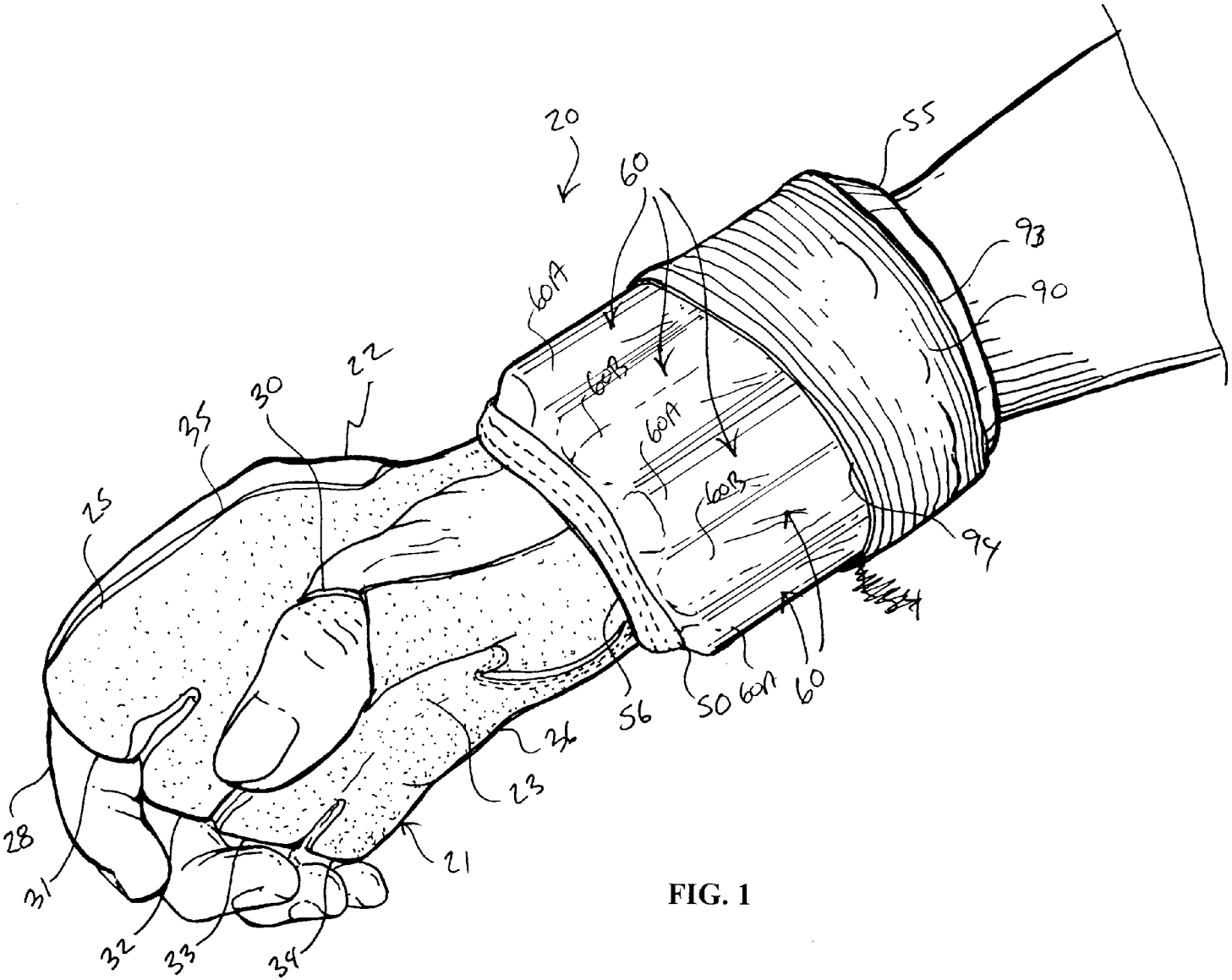
FIG. 1 is a palmar side perspective view of a glove constructed and arranged in accordance with the principle of the invention and shown as it would appear worn, the boxing training glove including a glove body including opposed proximal and distal ends, a wrist portion formed in the proximal end of the glove body, finger stalls formed in the distal end of the glove body, and an elongate strap wrapped about the proximal end of the glove body.

Turning now to the drawings, in which like reference characters indicate corresponding elements throughout the several views, attention is first directed to FIG. 1 in which there is seen a glove 20 constructed and arranged in accordance with the principle of the invention. In the present embodiment, glove 20 is a right hand glove. However, a glove constructed and arranged in accordance with the principle of the invention can be fashioned as a left hand glove without departing from the invention.

Glove 20 consists of a glove body 21 for receiving a human hand. Glove body 21 includes a dorsal side panel 22 and an opposing palmar side panel 23 and, as seen in FIGS. 3 and 4, a proximal end 24 and an opposing distal end 25. Referencing FIG. 7, proximal end 24 is formed with a wrist portion 26, which bounds an opening 27 into glove body 21 for receiving a hand 28 of a person. Finger stalls are formed in distal end 25 as seen in FIGS. 1-4, which include a thumb stall 30, an index finger stall 31, a middle finger stall 32, a ring finger stall 33, and a pinky finger stall 34. Glove body 21 also defines opposed sides 35 and 36, in which side 35 is the thumb side of glove body 21 and side 36 is the pinky side of glove body 21.

A wrist strap 40 illustrated in FIGS. 3-5 and 7 characterizes wrist portion 26. Wrist strap 40 is preferably formed of elastic material and has opposed ends 40A and 40B, and encircles and defines opening 27 referenced in FIGS. 5 and 7. Referencing FIGS. 4 and 5, wrist strap 40 is fashioned with an engagement element 41 carried by end 40A and a complemental engagement element 42 carried by end 40B used to open and close wrist strap 40. Engagement element 41 and complemental engagement element 42 are used to open and close wrist strap 40 by engaging and disengaging ends 40A and 40B relative to one another and adjust the dimension of opening 27. In the present embodiment, engagement element 41 is a hook medium and complemental engagement element 42 is a loop medium, although this arrangement can be reversed, if desired. The hook medium forming engagement element 41 and the loop medium forming complemental engagement element are exemplary of a hook and loop fastener. The hook and loop medium are preferably of the type sold under the trademark Velcro®. In other examples, engagement and complemental engagement elements 41 and 42 can include other types of fasteners to provide closure, such as complementary snap fasteners, button fasteners, clasp fasteners, etc.

Figure 4:
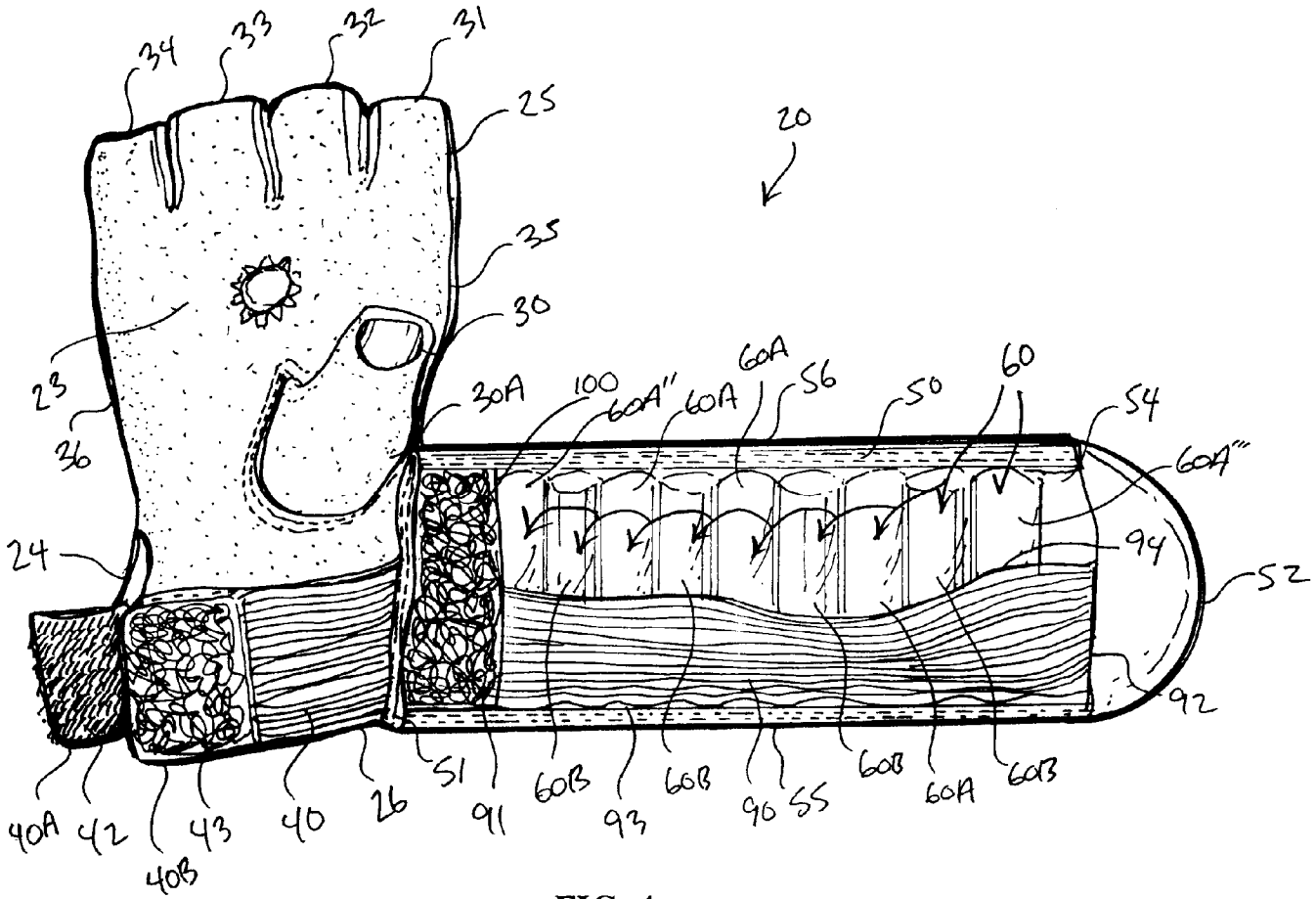
FIG. 4 is a palmar side plan view of the glove of FIG. 1 showing the elongate strap unwrapped relative to the proximal end of the glove body.
Figures 5, 6:
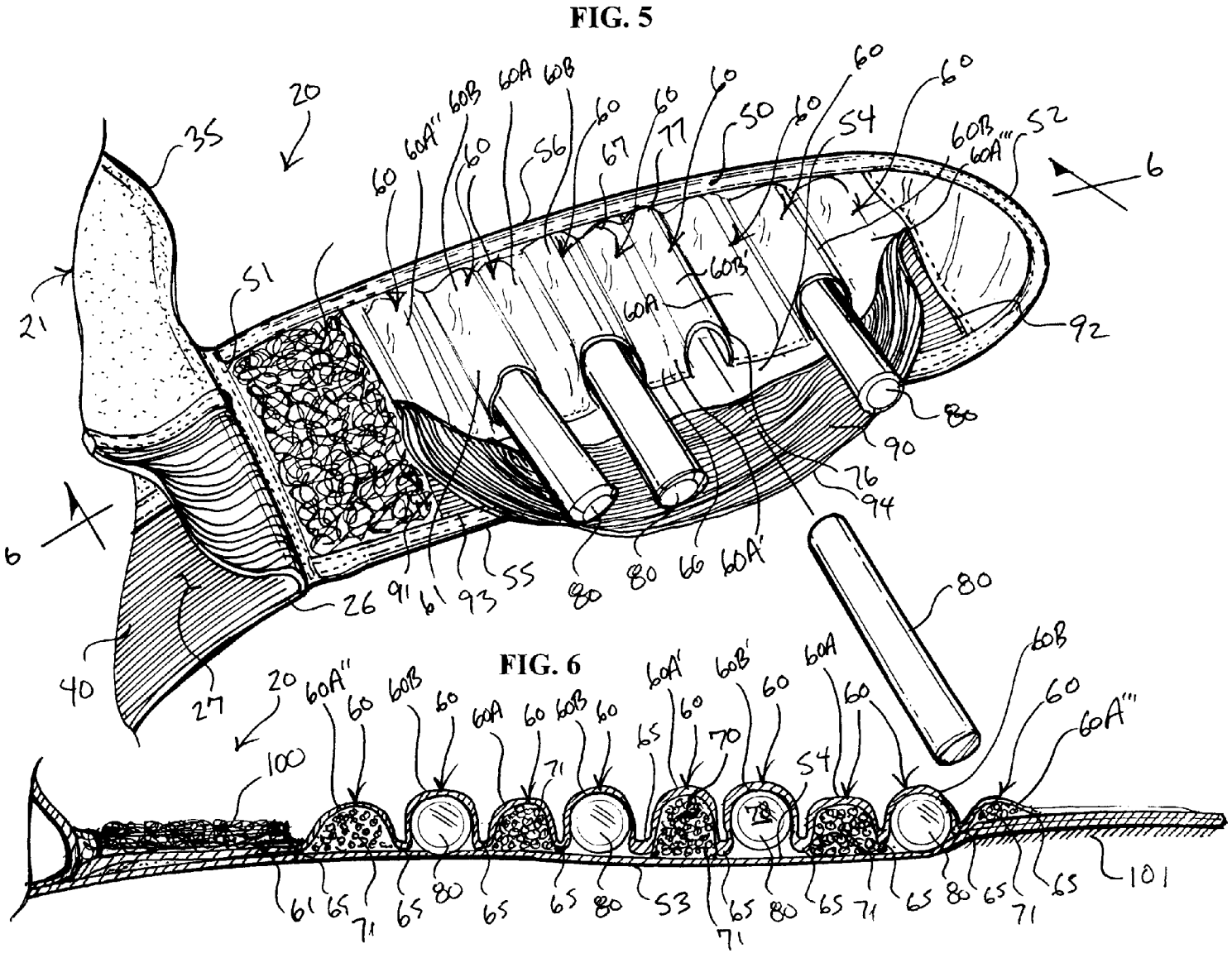
FIG. 5 is an enlarged fragmented perspective view of the glove of FIG. 1 illustrating the elongate strap unwrapped relative to the proximal end of the glove body and weight-receiving pockets formed in the elongate strap.
FIG. 6 is a sectional view taken along line 6-6 of FIG. 5.
Figure 7:
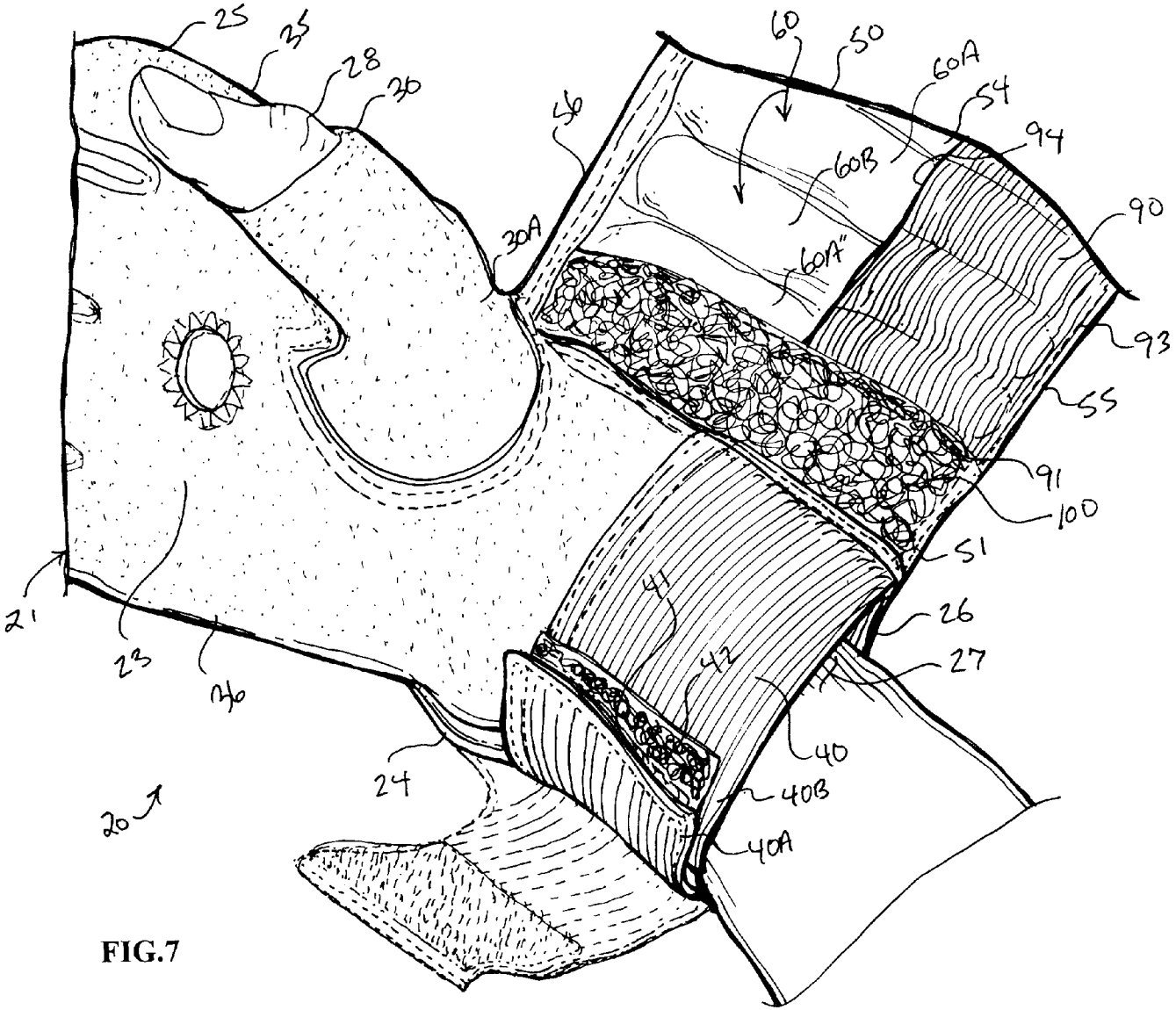
FIG. 7 is an enlarged fragmented perspective view of the glove of FIG. 1 shown as it would appear worn with the elongate strap unwrapped relative to the proximal end of the glove body.

Engagement and complemental engagement elements 41 and 42 are repeatedly moveable between an engaged position as shown in FIG. 7 and a disengaged position shown in FIG. 4 to provide opening 27 referenced in FIGS. 5 and 7 with a desired dimension. In this way, engagement and complemental engagement elements 41 and 42 are adjustable to adjust the force that wrist strap 40 exerts against wrist 29 of hand 28 as referenced in FIG. 7. In this example, the force is adjustable by changing the overly between ends 40A and 40B of wrist strap 40 in a well-known manner.

Referencing FIGS. 3-5, glove 20 incorporates a strap 50 having an inner end 51 secured to proximal end 24 of glove body 21 and an opposed free outer end 52. Strap 50 is elongate, broad, and flat, and includes an outer face 53 referenced in FIGS. 1-3 and 7, and an opposed inner face 54 referenced in FIGS. 4-7, a proximal edge 55, and an opposed, parallel distal edge 56. Looking to FIG. 7, in the preferred embodiment disclosed herein inner end 51 of strap 50 attached to proximal end 24 of glove body 21 extends along glove body 21 from adjacent to opening 27, along wrist strap 40 of wrist portion 26 to base 30A of thumb stall 30.

Strap 50 is formed with weighted features, and weight receiving features, in accordance with the principle of the invention. Looking to FIGS. 5 and 6, a plurality of pockets are formed in strap 50 between inner end 51 of strap and outer end 52 of strap 50. Pockets are each denoted generally at 60, are formed on outer face 54, and extend along outer face 54 of strap in a parallel row between inner end 51 and outer end 52 of strap 50, and extend between proximal and distal edges 55 and 56 of strap 50. Pockets 60 are substantially equal in size, although they may be constructed of varying sizes, if desired.

Pockets 60 are formed by a cooperation between a substrate 61 and outer face 54 of strap 50. Substrate 61 is an elongate piece of material applied to outer face 54 of strap 50, such as by sewing, gluing, or the like. As seen in FIG. 6, substrate 61 is joined to outer face 54 of strap 50 at substantially equally spaced apart parallel engagement points 65 extending in a parallel row from proximate to inner end 51 of strap 50 to outer end 52 of strap forming a pocket between each opposing pair of engagement points 65. For each pocket 60 the length of substrate 61 between the opposed engagement points 65 is much greater than the distance between the opposed engagement points 65 thereby forming a pocket as illustrated in FIG. 6.

Pockets 60 consist of alternating closed and open pockets. The closed pockets are each referenced with the reference number 60A, and the open pockets are each referenced with the reference number 60B. In the present embodiment as illustrated, pockets 60 consist of alternating closed and open pockets 60A and 60B, in which there are five closed pockets 60A and four open pockets 60B. Closed pockets 60A are each identical in structure, and open pockets 60B are each identical in structure. Accordingly only the structure of one closed pocket 60A and one open pocket 60B will be discussed in detail, with the understanding that the foregoing discussion of a closed pocket applies to each closed pocket and that the foregoing discussion of an open pocket applies to each open pocket. For reference purposes and ease of discussion, in FIG.

6 one of the closed pockets is denoted at 60A' and one of the open pockets is denoted at 60B'.

Closed pocket 60A' is elongate and as referenced in FIG. 5 has a closed proximal end 66 directed toward proximal edge 55, a closed distal end 67 directed toward distal edge 56, and opposed sides extending therebetween defined by engagement points 65 formed on either side of closed pocket 60A' as referenced in FIG. 6. Proximal and distal ends 66 and 67 of closed pocket 60A', and the opposed sides of pocket 60A' defined by engagement points 65 formed on either side of closed pocket 60A' together define the perimeter of closed pocket 60A', which is secured to outer face 54, such as by sewing or gluing or the like, thereby forming closed pocket 60A' between substrate 61 of outer face 54 defining and enclosing an enclosed space 70 as referenced in FIG. 6. Enclosed space 70 is filled with weighted material 71, which, in this instance, consists of a mass or population of small-diameter metal beads. Any suitable weight or weighted material may be enclosed in closed pocket 60A'

Open pocket 60B' is elongate and as referenced in FIG. 5 has an open proximal end 76 directed toward proximal edge 55, a closed distal end 77 directed toward distal edge 56, and opposed sides extending therebetween defined by engagement points 65 formed on either side of open pocket 60B' as referenced in FIG. 6. Proximal and distal ends 76 and 77 of open pocket 60B', and the opposed sides of pocket 60A' defined by engagement points 65 formed on either side of open pocket 60B' together define the perimeter of open pocket 60B', whereby the perimeter of open pocket 60B' along closed distal end 77 and the opposed sides of open pocket 60B' defined by engagement points formed on either side thereof are secured to outer face 54, such as by sewing or gluing or the like leaving proximal end 76 open leading into a space 78 formed by open pocket 60B' as referenced in FIG. 6.

Open pocket 60B' is sized to receive a weight, which, in this preferred embodiment, consists of an elongate, cylindrical bar 80 of steel, iron, or other weighted material or combination of weighted materials. To install bar 60 relative to open pocket 60B', bar 80 is taken up, such as by hand, and simply inserted end first into space 78 defined by open pocket 60B' through open proximal end 76. Bar 80 may easily be removed from open pocket 60B' simply by reversing the operation utilized to install or otherwise insert bar 80 into open pocket 60B'.

The weighted material 71 carried by closed pockets 60A imparts weight to strap 50. Inserting a weighted bar 80 into one or more of open pockets 60B' also imparts weight to strap 50. The overall weight applied to strap 50 may be adjusted simply by varying the number of weighted bars 80 applied to open pockets 60B.

Referencing FIGS. 4 and 6, a flap 90 is applied to outer face 54 of strap 50. Flap 90 is broad, flat, and elongate, and is elastically constrictive being constructed of elastic or elasticized material. Flap 90 has opposed inner end edges 91 and 92, and opposed proximal and distal edges 93 and 94. Inner edge 91 is secured to strap 50 between inner end 51 and the innermost one of pockets consisting of innermost pocket 60A", outer edge 92 is secured to strap 50 between outer end 52 and the outermost one of pockets consisting of outermost pocket 60A'", and proximal edge 93 is secured to and extends along proximal edge 55 of strap 50. Inner edge 91, outer edge 92 and proximal edge 93 are secured with sewing, glue, or the like. Inner edge 91 extends from proximal edge 55 of strap 50 along outer face 54 and then along substrate 61 terminating at an intermediate point between proximal and distal edges 55 and 56 of strap 50. Outer edge 92 extends from proximal edge 55 of strap 50 along outer face 54 and then along substrate 61 terminating at an intermediate point between proximal and distal edges 55 and 56 of strap 50. Distal edge 94 extending between inner and outer edges 91 and 92 is a free edge.

As seen in FIG. 4, flap 90 extends along outer face 54 of strap 50 from adjacent to inner end 51 of strap 50 to outer end 52 of strap 50, and distal edge 94 extends outwardly over pockets 60 between the proximal ends 66 and 76 of pockets 60 and distal ends 67 and 77 of pockets 60, such that flap 90 overlies pockets 60 covering proximal ends 66 and 76 of pockets 60. Proximal ends 66 and 76 of pockets 60 are not illustrated in FIG. 4 because flap 90 is extending across and covering them in FIG. 4 and thereby closing open proximal ends 76 of open pockets 60B'.

Flap 90 is movable from a normal, resting, or closed position as shown in FIG. 4 overlying proximal ends 66 and 76 of pockets 60, and an open position as illustrated in FIG. 5. In the open position illustrated in FIG. 5, distal edge 94 of flap 90 is taken up and drawn or otherwise pulled away from proximal ends 66 and 76 ends of pockets 60 revealing proximal ends 66 and 76 of pockets 60 and, with respect to open pockets 60B, thereby opening open proximal ends 76 of open pockets 60B allowing bars 80 to be easily installed and removed relative to open pockets 60B. To move flap 90 from the normal, resting, or closed position thereof as in FIG. 4 to the open position as illustrated in FIG. 5 distal edge 94 need only be taken up, such as by hand, and pulled away from pockets 60 in a direction toward proximal edge 55 of strap 50. The elastically constrictive characteristic imparted by flap 90 causes flap to move from the open position thereof as shown in FIG. 5 to the normal, resting, or closed position thereof as shown in FIG. 4 simply by releasing the force applied to flap 90 to open flap 90. With one or more bars 80 disposed in one or more of open pockets 60B, flap 90 disposed in the closed position as in FIG. 4 closes open proximal ends 76 of open pockets 60B preventing each installed bar 80 from falling away from its respective open pocket 60B, in accordance with the principle of the invention.

Referencing FIG. 6, strap 50 is fashioned with an engagement element 100 and a complemental engagement element 101. Engagement element 100 is applied to outer face 54 of strap at inner end 51 between the innermost pocket 60A" and glove body 21, and complemental engagement element 101 is applied to inner face 53 of strap 50 at outer end 52 between the outermost pocket 60A'" and outer end 52 of strap 50.

Figure 2:
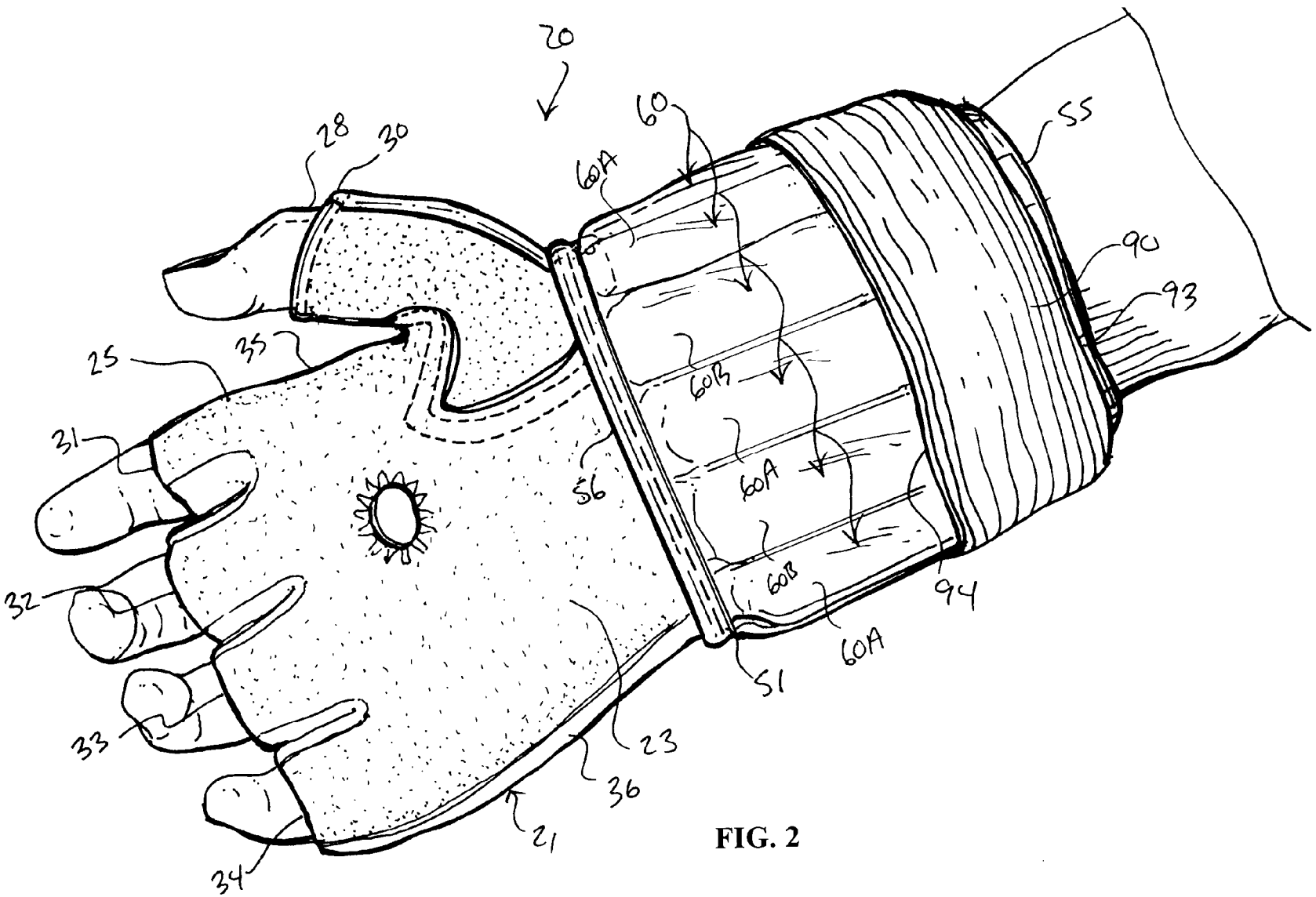
FIG. 2 is a palmar side plan view of the glove of FIG. 1 shown as it would appear worn.
Figure 3:
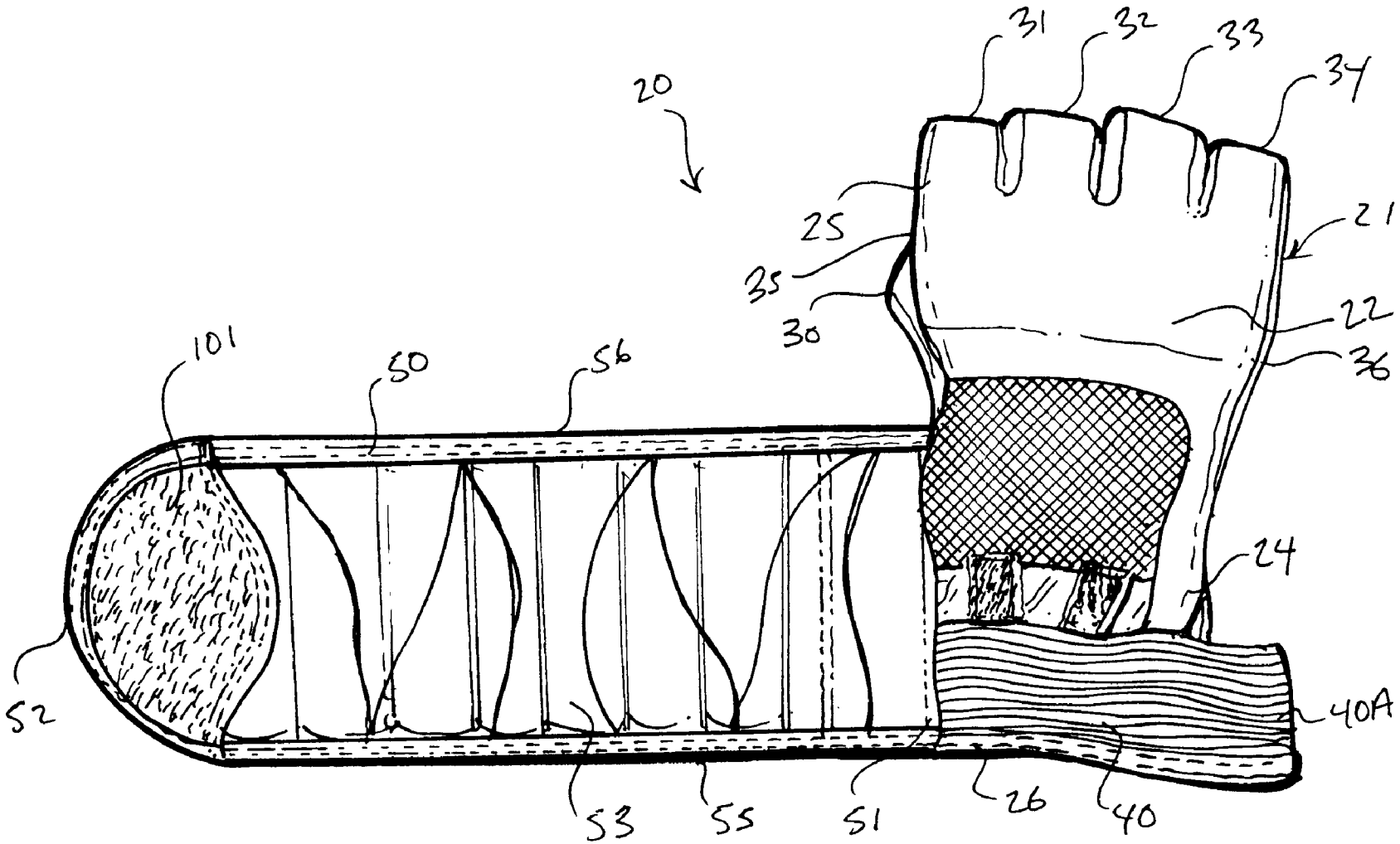
FIG. 3 is a dorsal side plan view of the glove of FIG. 1 showing the elongate strap unwrapped relative to the proximal end of the glove body.

Strap 50 is movable between a first or open position extending away from proximal end 24 and wrist portion 26 of glove body 21 as illustrated in FIGS. 3 and 4, and a second, closed or wrapped position wrapped about proximal end 24 of glove body 21, including wrist portion 26 and wrist strap 40 characterizing wrist portion 26 as illustrated in FIGS. 1 and 2. In the second or wrapped position of strap 50, engagement element 100 is brought into engagement with complemental engagement element 101 thereby securing strap 50 in the second or wrapped position.

Engagement element 100 and complemental engagement element 100 are used to open and close strap 50 by engaging and disengaging inner and outer ends 51 and 52 of strap relative to one another in the wrapped position of strap 50. In the present embodiment, engagement element 100 is a loop medium and complemental engagement element 101 is a hook medium, although this arrangement can be reversed, if desired. The loop medium forming engagement element 100 and the hook medium forming complemental engagement element 101 are exemplary of a loop and hook fastener. The loop and hook medium are preferably of the type sold under the trademark Velcro®. In other examples, engagement and complemental engagement elements 100 and 101 can include other types of fasteners to provide closure, such as complementary snap fasteners, button fasteners, clasp fasteners, etc.

In the wrapped position of strap 50, engagement and complemental engagement elements 100 and 101 are repeatedly moveable between an engaged position securing strap 50 in the wrapped position and a disengaged position allowing strap 500 to be unwrapped and moved into the first or unwrapped position as illustrated in FIGS. 3 and 4. The engagement and complemental engagement elements 100 and 101 are adjustable to adjust the force that strap 50 exerts about proximal end 24, including wrist portion 26, wrist 29 of hand 28 as referenced in FIG. 7. In this example, the force is adjustable by changing the overly between ends 40A and 40B of wrist strap 40 in a well-known manner.

Strap 50 is wrapped inwardly relative to proximal end 24 of glove body 21 juxtaposing inner face 53 about proximal end 24 of glove body 21 including wrist portion 26 and wrist strap 40, whereby engagement element 100 disposed along outer face 54 of strap 50 proximate inner end 51 is brought into engagement with complemental engagement element 101 disposed along inner face 53 of strap 50 proximate outer end 52. In the wrapped position of strap 50 as shown in FIGS. 1 and 2, pockets 60 project outwardly from outer face 54 of strap 50, flap 90 is disposed in the closed position thereof closing open proximal ends 76 (not referenced in FIGS. 1 and 2) of open pockets 60B' preventing any weighted bars from dislodging relative to strap 50, and flap 90 is elastically stretched tightly across outer face 54 and pockets 60 thereby preventing flap 90 from moving out of its closed position, in accordance with the invention.

In use, glove 20 is applied to and worn by hand 28 in the normal manner as illustrated in FIGS. 1 and 2, wrist strap 40 (FIG. 7) is tightened about the wrist, and strap 50 is wrapped about proximal end 24 of glove body 21, including wrist portion 26 and wrist strap 40. So worn, a user may utilize glove 20 for a selected purpose, whereby the weight supported by strap 50 as provided by any bars 80 applied to open pockets 60B and the weight applied to the closed pockets 60A provides weight resistance providing resistance training benefits, namely, for improving muscle strength.

Glove 20 can be used for any desired purpose or action, but is particular suitable as a boxing training glove, in which the weight resistance provided by the weight applied to strap 50 provides resistance training benefits specific for boxing. Although not shown, dorsal side panel 22 is provided with protective knuckle padding toward distal end 25 of glove body 21 for overlying and protecting the user's knuckles during boxing practice activities.

Again, the weight imparted to strap 50 may be varied by varying the number of bars 80 applied to strap 50. Closed pockets 60A containing weighted material 71 provide strap 50 with a fixed amount of weight thereby imparting a baseline level of weight to strap 50. Open pockets 60B are used to increase the weight imparted to strap 50 above the baseline weight imparted to strap by weighted material 71 in closed pockets 60A by simply adding one or more bars 80 to open pockets 60B as may be desired in accordance with the principle of the invention.

Glove 20 can be constructed using many different materials and utilizing fabrication methods standard within the art. Glove body 21 and strap 50 are preferably constructed with elastic material designed to stretch slightly to allow glove 20 to fit many different sizes of hands and to place a slight bias on the person's hand to hold it firmly in place. An example of suitable materials that may be used to construct glove 20 include leather, cotton, polyester, neoprene, or the like. Glove body 21 can be constructed as a single integral piece, or may be constructed of multiple pieces that are attached together such as by sewing, gluing, etc.

Figure 8:
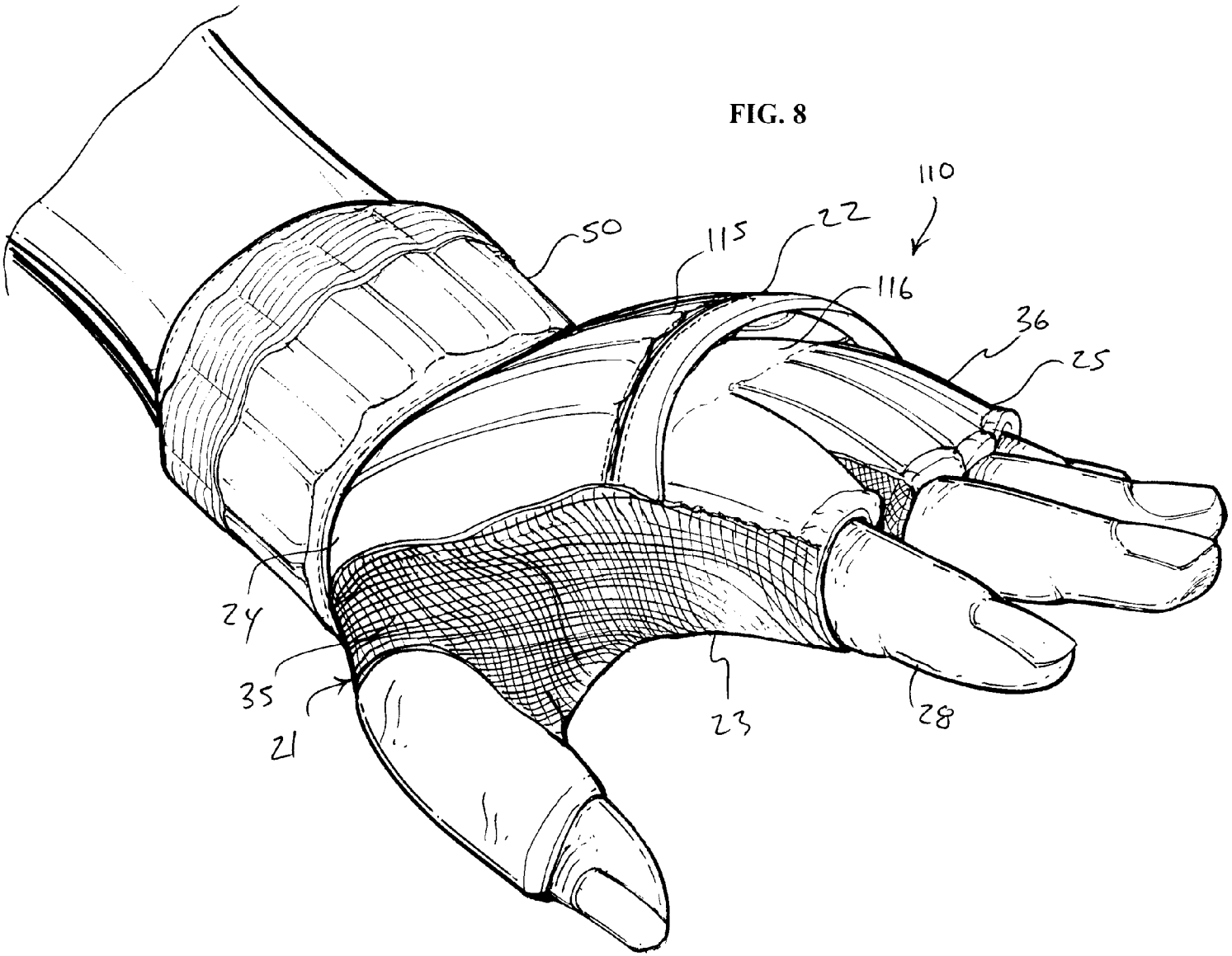
FIG. 8 is a perspective view of a glove constructed and arranged in accordance with the an alternate embodiment of the invention and shown as it would appear worn and disposed in a splayed configuration, the glove including a glove body having opposed dorsal and palmar side panels, opposed proximal and distal ends, a wrist portion formed in the proximal end of the glove body, finger stalls formed in the distal end of the glove body, and an elongate strap wrapped about the proximal end of the glove body, in which the palmar side panel is severed forming a first portion of the dorsal side panel toward the proximal end of the glove body and a second portion of the dorsal side panel toward the distal end of the glove body.
Figure 10:
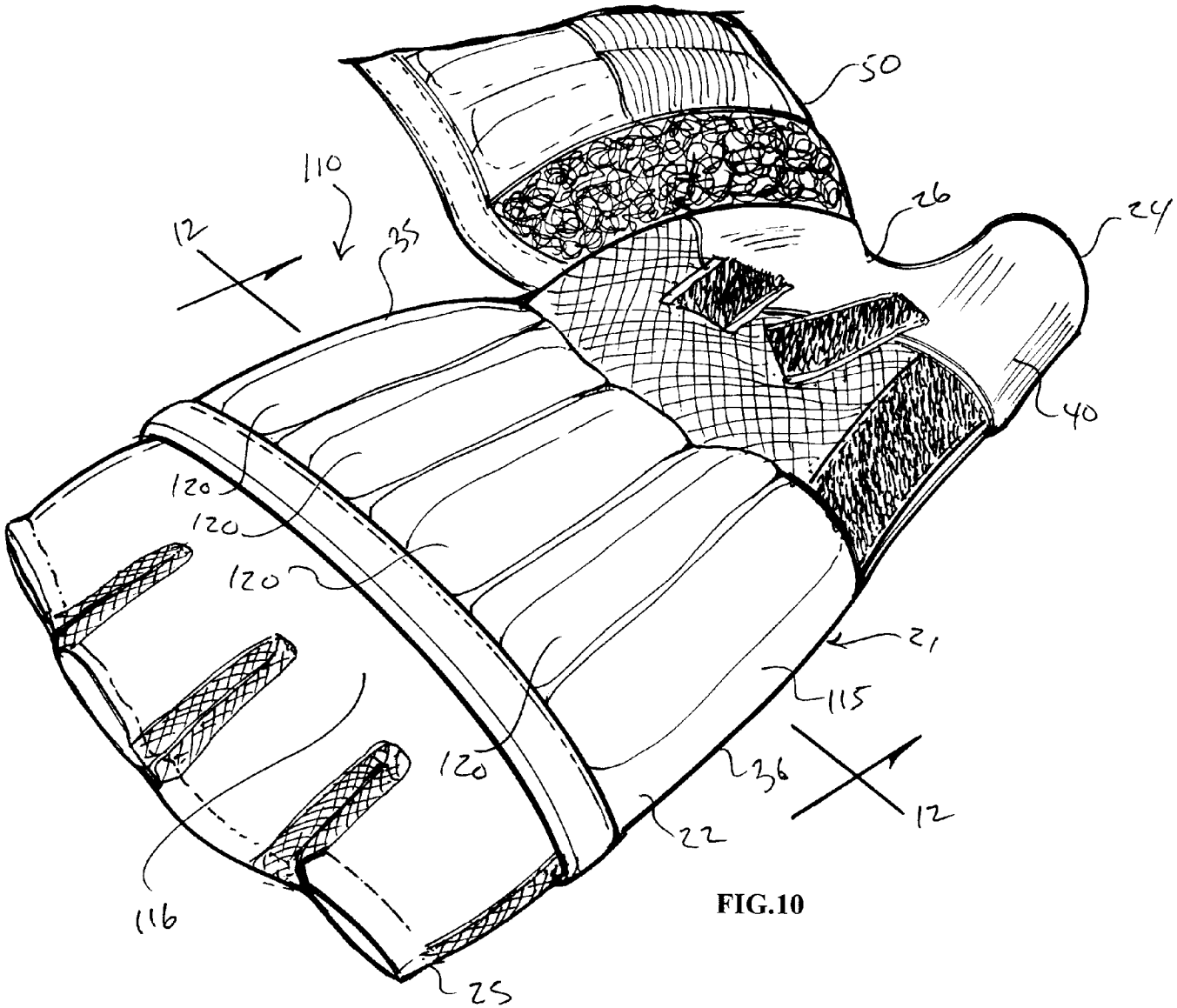
FIG. 10 is an enlarged fragmented dorsal side perspective view of the glove of FIG. 8 shown with the elongate strap unwrapped relative to the proximal end of the glove body.

Reference is now made to FIG. 8, in which there is seen a glove 110 constructed and arranged in accordance with an alternate embodiment of the invention. In common with glove 20, glove 110 shares glove body 21, dorsal side panel 22, palmar side panel 23, proximal end 24 including wrist portion 26 and wrist strap 40 as shown in FIG. 10, distal end 25 formed with finger stalls, opposed sides 35 and 36, and strap 50. Glove 110 is a left hand glove, but is otherwise the same as glove 10 with the exception of the differences to be discussed below. Glove 110 may be constructed as a right hand glove if desired.

Figure 9:
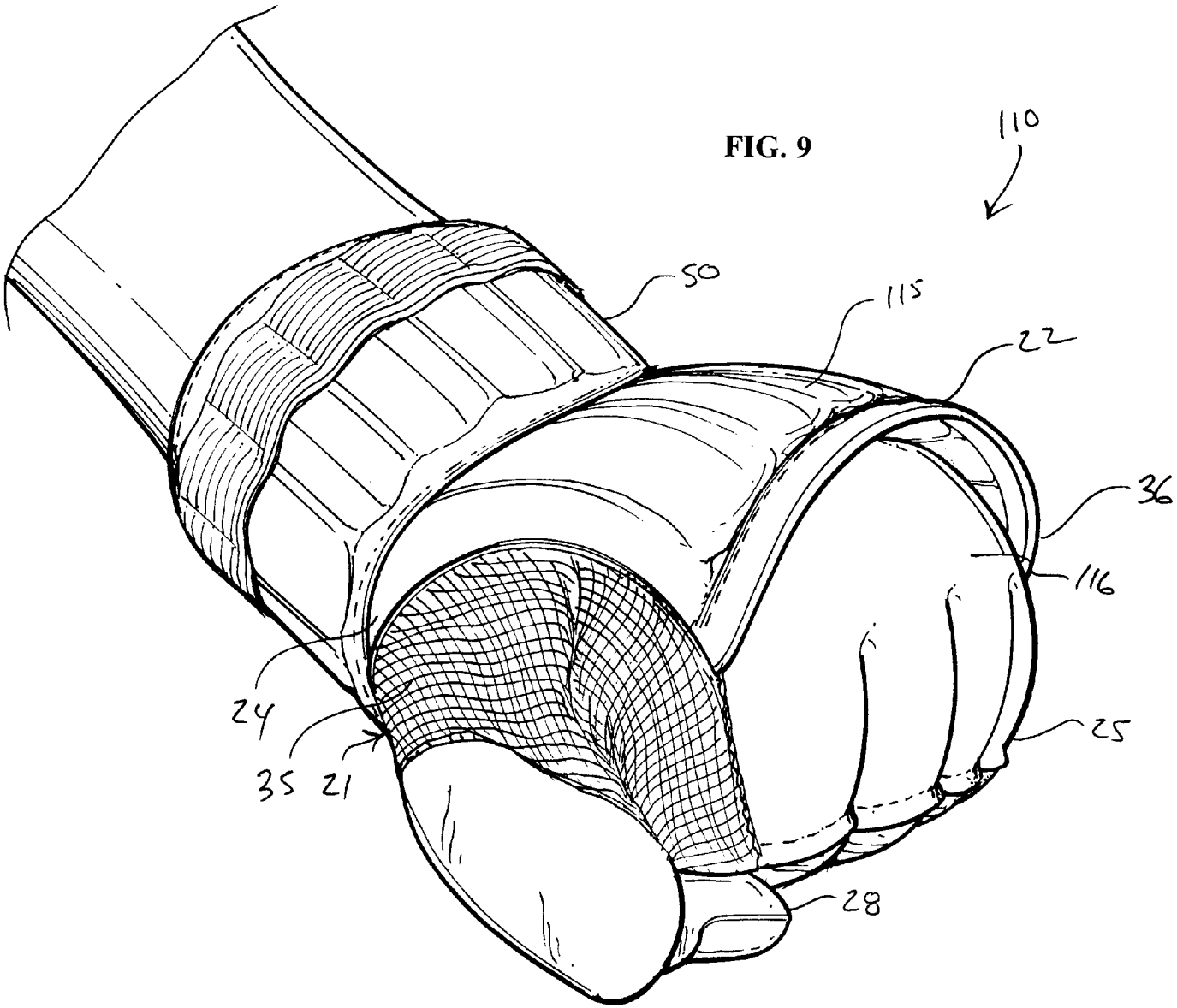
FIG. 9 is a view very similar to that of FIG. 8 illustrating the glove as it would appear in a fisted configuration displacing the second portion of the dorsal side panel relative to the first portion of the dorsal side panel.

Unlike glove 20, dorsal side panel 22 of glove 110 is longitudinally from side 35 of glove body 21 to side 36 of glove body 21 at a point between proximal and distal ends 24 and 25 of glove body 21 forming a first or proximal portion 115 of dorsal side panel 22 toward proximal end 24 of glove body 21, and a second or distal portion 116 of dorsal side panel 22 toward distal end 25 of glove body 21. In this embodiment, proximal portion 115 somewhat overlaps and overlies distal portion 116, although this can be reversed. Because dorsal side panel 22 is severed, proximal and distal portions 115 and 116 are capable of displacing relative to each other in response to the hand 28 of user wearing glove 110 moving between a splayed position as shown in FIG. 8 placing glove 110 in a splayed position and a fisted position as shown in FIG. 9 placing glove 110 in a fisted position. In other words, in the splayed position of glove 110 as shown in FIG. 8 distal portion 116 is directed toward proximal portion 115, and in the fisted position of glove 110 as shown in FIG. 9 distal portion 116 is displaced away from proximal portion 115 thereby allowing the user to easily assume a fist while wearing glove 110. The severed characteristic of dorsal side panel 22 allows proximal and distal portions 115 and 116 of dorsal side panel 22 to move or otherwise displace toward and away from each other allowing the hand of a user wearing glove 110 to easily move between splayed and fisted positions, in accordance with the principle of the invention.

Figure 11:
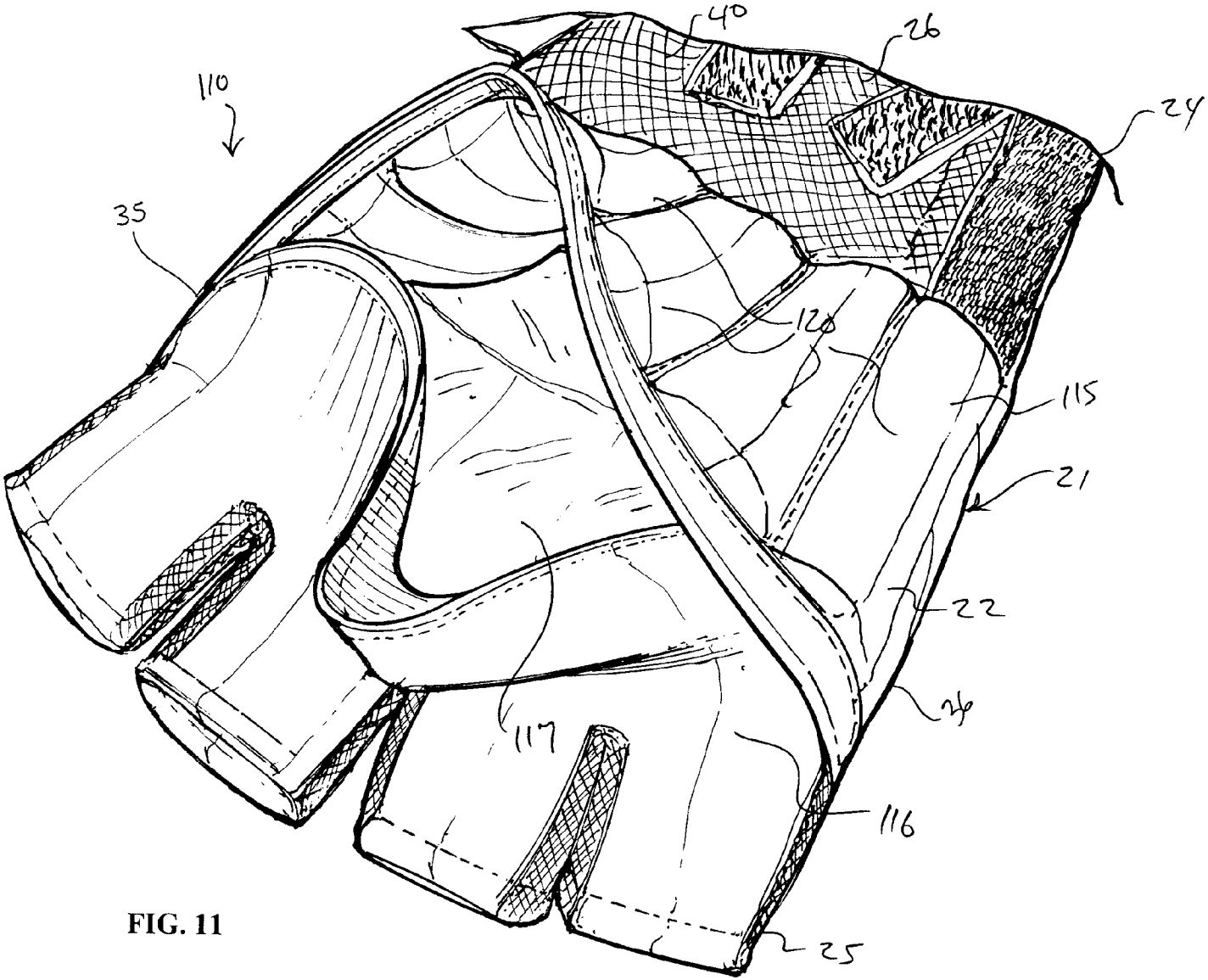
FIG. 11 is an enlarged fragmented dorsal side perspective view of the glove of FIG. 8 shown with the first and second portions of the dorsal side panel pulled apart relative to each other illustrating a protective knuckle pad formed in the second portion of the dorsal side panel.

Like glove 20, glove 110 can be used for any desired purpose or action, but is particular suitable as a boxing training glove, in which the weight resistance provided by the weight applied to strap 50 provides resistance training benefits. As seen in FIG. 11, distal portion 116 of dorsal side panel 22 is provided with protective knuckle padding 117 toward distal end 25 of glove body 21 for overlying and protecting the user's knuckles during boxing practice activities. The same type of knuckle padding is provided with glove 20.

Figure 12:
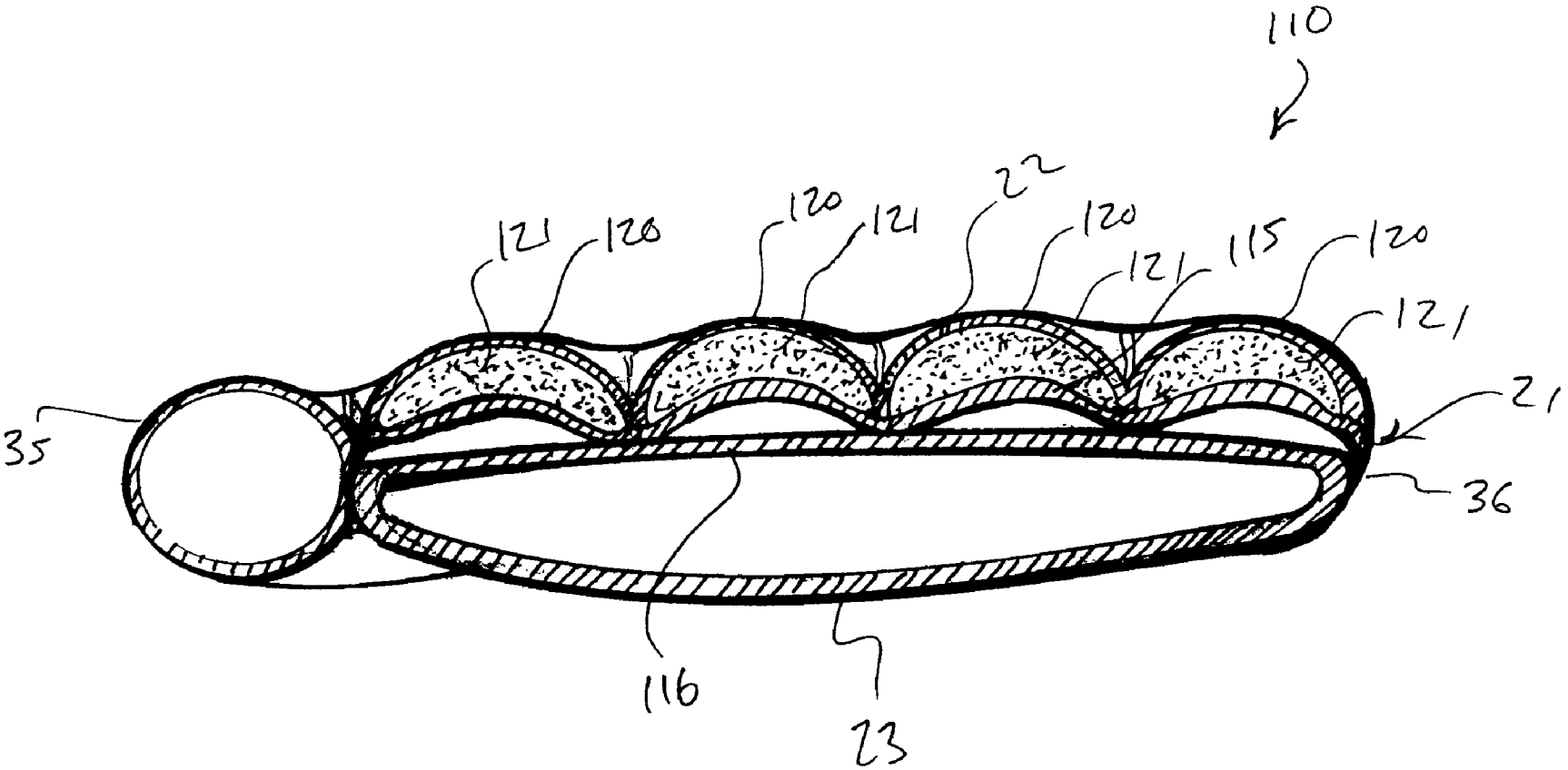
FIG. 12 is a sectional view taken along line 12-12 of FIG. 10.

Referencing FIGS. 10 and 12, equally spaced-apart parallel closed pockets 120 containing weighted material 121 are formed in proximal portion 115 of dorsal side panel 22. Pockets 120 extend in a parallel row across proximal portion 115 of dorsal side panel 22 from side 35 of glove body 21 to side 36 of glove body 21, and provide weight resistance to glove 110 for providing added weight resistance characteristics in addition to the weight resistance characteristics provided by strap 50. Any number of pockets 120 containing weighted material 121 can be used in connection with glove 110. If desired, proximal portion 115 of dorsal side panel 22 may be fashioned with one or more open pockets each for removably receiving a weight consistent with the teachings relating to strap 50. In this embodiment, weighted material 121 contained in each pocket 120 consists of a mass or population of small-diameter metal beads. Pockets 120 containing weighted material 121 will naturally impart a certain amount of rigidity to proximal portion 115 of dorsal side panel 22. As a result, the severed characteristic of dorsal side panel 22 allows proximal and distal portions 115 and 116 of dorsal side panel 22 to move or otherwise displace toward and away from each other allowing the hand of a user wearing glove 110 to easily move between splayed and fisted positions notwithstanding the rigid characteristic imparted to proximal portion 115 of dorsal side panel 22 imparted by pockets 120 containing weighted material 121, in accordance with the principle of the invention. The weighted material 121 carried by each pocket 120 may be considered a weight. Because glove 110 incorporates a plurality of pockets 120 each containing weighted material 121, proximal portion 112 carries a plurality of weights.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A glove, comprising:

a glove body including opposing dorsal and palmar side panels, opposing proximal and distal ends, a wrist strap formed in the proximal end to be received about a wrist and that bounds an opening into the glove body, and finger stalls formed in the distal end;

an elongate strap having an inner end secured to the proximal end of the glove body, including the wrist strap formed in the proximal end of the glove body, and an opposed free outer end, and a plurality of weight-receiving pockets formed in the elongate strap between the inner end of the elongate strap and the outer end of the elongate strap;

the elongate strap movable between a first position extending away from the proximal end of the glove body, including the wrist strap formed in the proximal end of the glove body, and a second position wrapped about the proximal end, including the wrist strap formed in the proximal end of the glove body; and means for securing the elongate strap in the second position.

2. The glove according to claim 1, the pockets each including a closed end and an opposed open end for installing and removing a weight relative to the pocket.

3. The glove according to claim 2, further comprising a flap secured to the elongate strap, the flap movable between an open position exposing the open ends of the pockets and a closed position extending across and closing the open ends of the pockets.

4. The glove according to claim 3, wherein the flap is elastically constrictive biasing the flap in the closed position.

5. The glove according to claim 1, wherein the means for securing the elongate strap in the second position comprises an engagement element formed proximate to the inner end of the elongate strap and a complemental engagement element formed proximate to the outer end of the elongate strap.

6. The glove according to claim 5, wherein the engagement element comprises one of a hook medium and a loop medium, and the complemental engagement element comprises the other of the hook medium and the loop medium.

7. The glove according to claim 1, further comprising:

the dorsal side panel severed forming a first portion of the dorsal side panel toward the proximal end of the glove body and a second portion of the dorsal side panel toward the distal end of the glove body;

the second portion of the dorsal side panel capable of displacing between a first position away from the first portion of the dorsal side panel and a second position toward the first portion of the dorsal side panel.

8. The glove according to claim 7, further comprising protective knuckle padding formed in the second portion of the dorsal side panel.

9. The glove according to claim 8, further comprising weights carried by the first portion of the dorsal side panel.

10. A glove, comprising:

a glove body including opposing dorsal and palmar side panels, opposing proximal and distal ends, a wrist strap formed in the proximal end to be received about a wrist and that bounds an opening into the glove body, and finger stalls formed in the distal end;

an elongate strap having an inner end secured to the proximal end of the glove body, including the wrist strap formed in the proximal end of the glove body, and an opposed free outer end;

weights carried by the elongate strap between the inner end of the elongate strap and the outer end of the elongate strap;

corresponding engagement and complemental engagement elements carried by the elongate strap;

the elongate strap movable between a first position extending away from the proximal end of the glove body, including the wrist strap formed in the proximal end of the glove body, and a second position wrapped about the proximal end of the glove body, including the wrist strap formed in the proximal end of the glove body, engaging the engagement element to the complemental engagement element securing the elongate strap in the second position.

11. The glove according to claim 10, wherein the engagement element is formed proximate to the inner end of elongate strap and the complemental engagement element is formed proximate to the outer end of the elongate strap.

12. The glove according to claim 10, wherein the engagement element comprises one of a hook medium and a loop medium, and the complemental engagement element comprises the other of the hook medium and the loop medium.

13. The glove according to claim 10, further comprising:

the dorsal side panel severed forming a first portion of the dorsal side panel toward the proximal end of the glove body and a second portion of the dorsal side panel toward the distal end of the glove body;

the second portion of the dorsal side panel capable of displacing between a first position away from the first portion of the dorsal side panel and a second position toward the first portion of the dorsal side panel.

14. The glove according to claim 13, further comprising protective knuckle padding formed in the second portion of the dorsal side panel.

15. The glove according to claim 14, further comprising weights carried by the first portion of the dorsal side panel.

16. A glove, comprising:

a glove body including opposing dorsal and palmar side panels, opposing proximal and distal ends, a wrist strap formed in the proximal end to be received about a wrist and that bounds an opening into the glove body, and finger stalls formed in the distal end;

the dorsal side panel severed forming a first portion of the dorsal side panel toward the proximal end of the glove body and a second portion of the dorsal side panel toward the distal end of the glove body, the second portion of the dorsal side panel formed with protective knuckle padding;

the second portion of the dorsal side panel capable of displacing between a first position away from the first portion of the dorsal side panel and a second position toward the first portion of the dorsal side panel;

an elongate strap having an inner end secured to the proximal end of the glove body, including the wrist strap formed in the proximal end of the glove body, and an opposed free outer end, and a plurality of weight-receiving pockets formed in the elongate strap between the inner end of the elongate strap and the outer end of the elongate strap;

an engagement element carried by the inner end of the elongate strap and a corresponding complemental engagement element carried by the outer end of the elongate strap;

the elongate strap movable between a first position extending away from the proximal end of the glove body, including the wrist strap formed in the proximal end of the glove body, and a second position wrapped about the proximal end of the glove body, including the wrist strap formed in the proximal end of the glove body, engaging the engagement element to the complemental engagement element securing the elongate strap in the second position.

17. The glove according to claim 16, the pockets each including a closed end and an opposed open end for installing and removing a weight relative to the pocket.

18. The glove according to claim 17, further comprising a flap secured to the elongate strap, the flap movable between an open position exposing the open ends of the pockets and a closed position extending across and closing the open ends of the pockets.

19. The glove according to claim 18, wherein the flap is elastically constrictive biasing the flap in the closed position.

20. The glove according to claim 16, further comprising weights carried by the first portion of the dorsal side panel.

* * * * *